US009062455B2

(12) United States Patent
Rice

(10) Patent No.: US 9,062,455 B2
(45) Date of Patent: Jun. 23, 2015

(54) HORIZONTAL BLOCKING MEMBER FOR USE IN A WALL STUD SYSTEM

(71) Applicant: Bailey Metal Products Limited, Concord (CA)

(72) Inventor: John Rice, Aurora (CA)

(73) Assignee: Bailey Metal Products Limited, Concord, ON (CA)

( * ) Notice: Subject to any disclaimer, the term of this patent is extended or adjusted under 35 U.S.C. 154(b) by 0 days.

(21) Appl. No.: 13/852,959

(22) Filed: Mar. 28, 2013

(65) Prior Publication Data

US 2014/0290176 A1 Oct. 2, 2014

(51) Int. Cl.
*E04B 2/74* (2006.01)
*E04C 3/02* (2006.01)

(52) U.S. Cl.
CPC ..... *E04B 2/7457* (2013.01); *E04B 2002/7485* (2013.01); *E04C 2003/026* (2013.01)

(58) Field of Classification Search
CPC ..... E04B 2002/7485; E04B 2/7457; E04C 2003/026; E04C 3/02
USPC ..... 52/317, 696, 481.1, 489.1, 643
See application file for complete search history.

(56) References Cited

U.S. PATENT DOCUMENTS

| | | | | | |
|---|---|---|---|---|---|
| 4,246,736 | A * | 1/1981 | Kovar et al. | ..... | 52/696 |
| 5,189,857 | A * | 3/1993 | Herren et al. | ..... | 52/317 |
| 5,606,837 | A * | 3/1997 | Holizlander | ..... | 52/693 |
| 5,884,448 | A * | 3/1999 | Pellock | ..... | 52/643 |
| 6,253,529 | B1 * | 7/2001 | De Boer | ..... | 52/763 |
| 6,260,318 | B1 * | 7/2001 | Herren | ..... | 52/317 |
| 6,393,794 | B1 * | 5/2002 | Pellock | ..... | 52/696 |
| 6,418,682 | B1 * | 7/2002 | Rice | ..... | 52/241 |
| 7,331,149 | B2 * | 2/2008 | Tollenaar | ..... | 52/481.1 |
| 7,520,100 | B1 * | 4/2009 | Herrman et al. | ..... | 52/481.1 |
| 7,596,921 | B1 * | 10/2009 | diGirolamo et al. | ..... | 52/696 |
| 7,748,187 | B2 * | 7/2010 | Sensenig | ..... | 52/489.1 |
| 7,836,657 | B1 * | 11/2010 | diGirolamo et al. | ..... | 52/712 |

* cited by examiner

*Primary Examiner* — Jeanette E. Chapman
*Assistant Examiner* — Daniel Kenny

(57) ABSTRACT

The invention pertains to a blocking member that cooperates with adjacent blocking members to provide securement throughout the entire width of the blocking member. The blocking member comprises a male portion at one end thereof and a cooperating female portion at the opposing end. The male and female flanges are shaped such that when a first horizontal blocking member is placed adjacent a second horizontal blocking member, the male member fits within the female member such that there is no large discontinuity in the width of the horizontal blocking members at the joint between a first horizontal blocking member and a second horizontal blocking member.

4 Claims, 5 Drawing Sheets

2
6
10
10
10
10
12
4
4
4
8

HORIZONTAL BLOCKING MEMBER FOR USE IN A WALL STUD SYSTEM

FIELD OF THE INVENTION

The present application relates to a blocking member for providing additional structural support to a wall stud system. The invention further pertains to a wall stud system incorporating such a blocking structure.

BACKGROUND OF THE INVENTION

It is common practice in both commercial and residential buildings to separate and define rooms using partition walls. These walls are typically constructed of a wood or sheet metal stud system. The stud system typically comprises a top track located horizontally at ceiling level, a bottom track located horizontally along the floor and the vertical members are secured there between. The vertical members are generally spaced evenly throughout the length of the wall.

Drywall is typically mounted on the outside of the stud structure. Since drywall is not strong, support structures or blocking members can be used to provide structural support to the stud wall structure and provide a location in which fixtures can be attached. Often times the support is needed to attach crown molding, handrails, cabinets or other fixtures.

Some blocking members are currently available. However many of these blocking members attach solely to one surface of vertical support studs and the fixation means does not span the width of the blocking member. These members typically have flanges that are situated adjacent a side flange of the vertical structural stud member. Since blocking members are typically secured to the vertical stud adjacent to each other in a horizontal line, in these models each securement flange would only be able to secure to half of the width of the front flange of the vertical stud member.

In order to increase strength, it would be desirable to have a blocking member which can cooperate with adjacent blocking members to provide securement throughout the entire width of the blocking member.

SUMMARY OF THE INVENTION

The invention pertains to a blocking member that cooperates with adjacent blocking members to provide securement throughout the entire width of the blocking member. The blocking member comprises a male portion at one end thereof and a cooperating female portion at the opposing end. The male and female portions are shaped such that when a first horizontal blocking member is placed adjacent a second horizontal blocking member, the male portion fits within the female portion such that there is no large discontinuity in the width of the horizontal blocking members at the joint between a first horizontal blocking member and a second horizontal blocking member.

In an aspect of the invention there is provided a horizontal blocking member for use in a structural stud building system having a plurality of vertical support studs. Each support stud has a front flange and rear flange integrally connected to a web having a front and rear surface. The blocking member comprises a web having a top edge and a bottom edge, a first lateral edge extending between the top edge and the bottom edge and a second lateral edge opposite said first lateral edge extending between the top edge and the bottom edge. The first lateral edge includes a male portion and the second lateral edge includes a cooperating female portion such that when the first lateral edge of a first horizontal blocking member is placed adjacent the second lateral edge of a second horizontal blocking member the overall width of the blocking members is maintained at the joint between the first and second horizontal blocking members.

In a further aspect of the invention the male portion of the horizontal blocking member is in the form of a tab extending from said web of said horizontal blocking member.

In yet a further aspect of the invention, the horizontal blocking member further comprises a top flange integrally connected to and extending from said top edge at an angle generally perpendicular to the web and a bottom flange integrally connected to and extending from the bottom edge at an angle perpendicular to the web.

In yet a further aspect of the invention, the horizontal blocking member further comprises a securement structure extending from the web for securing said horizontal blocking structure to a web of a vertical support stud.

In yet a further aspect of the invention, the securement structure of the horizontal blocking member includes a first foot extending from the top flange and a second foot extending from the bottom flange. When positioned between said vertical studs, both the first foot and the second foot lie parallel and adjacent to said rear surface of said web of said vertical stud.

In yet a further aspect of the invention, the securement structure further includes a securement flap located at the opposite lateral edge of the first foot and the second foot. The securement flap is directed generally perpendicular to the web and lies generally parallel and adjacent the front surface of the web of the vertical stud.

In yet a further aspect of the invention, the first foot and the second foot are adapted to be coupled to the web of the vertical stud.

In yet a further aspect of the invention, the horizontal blocking member is used in a wall stud system comprising a first structural stud having a first flange and a second flange integrally connected to a web having a front and rear surface and a second structural stud having a first flange and a second flange integrally connected to a web having a front and rear surface. The male portion of the horizontal blocking member is coupled to the first flange of the first structural stud and the female portion of said horizontal blocking member being coupled to the first flange of the second structural stud.

BRIEF DESCRIPTION OF THE DRAWINGS

Preferred embodiments of the present invention are illustrated in the attached drawings in which.

DETAILED DESCRIPTION OF THE PREFERRED EMBODIMENTS

Figure 1:
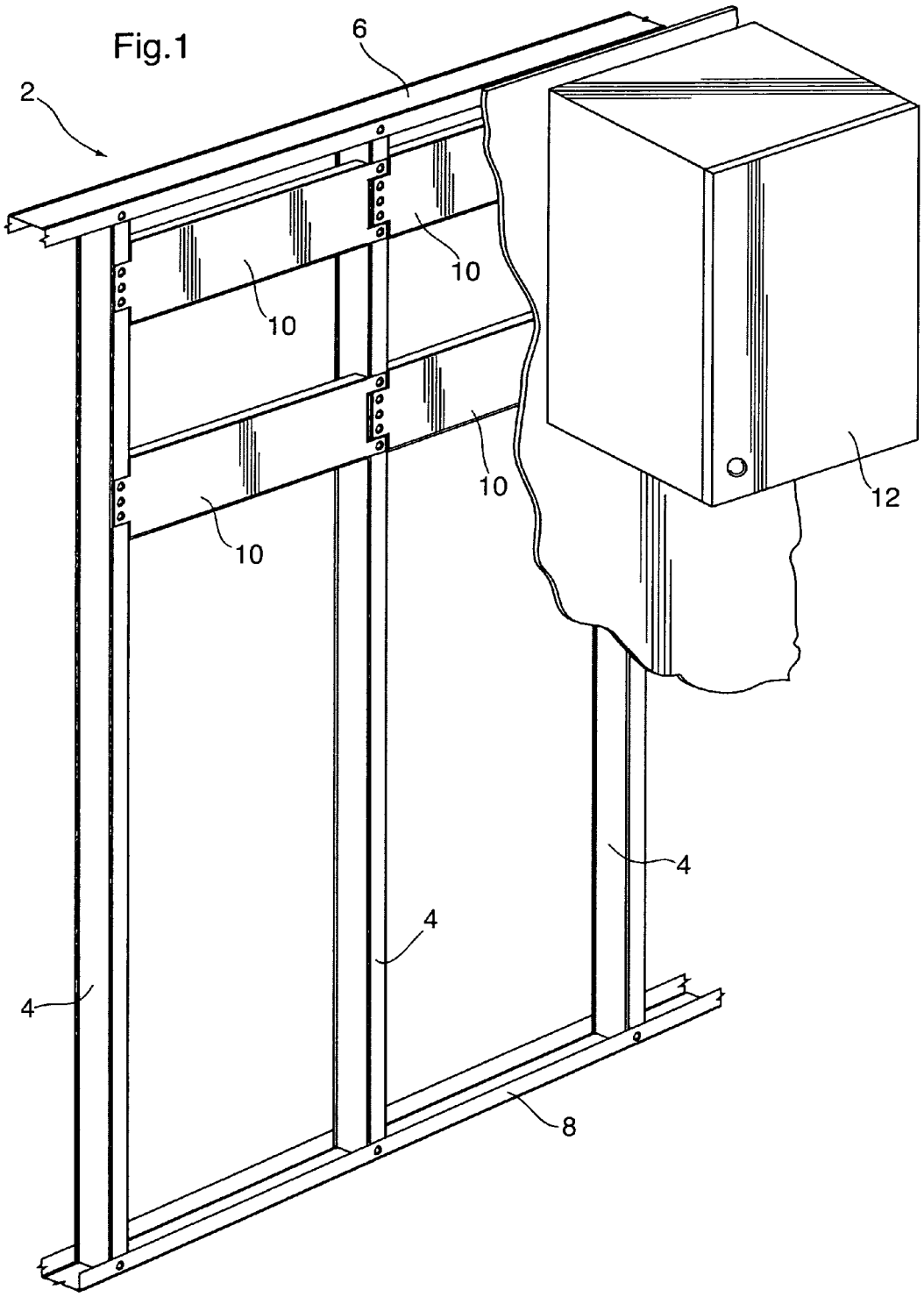
FIG. 1 illustrates a wall stud system incorporating the horizontal blocking member.

FIG. 1 illustrates a metal wall stud system 2 comprising vertical studs 4, disposed between an upper track 6 and a lower track 8. Portions of the wall requiring increased strength are fitted with horizontal blocking members 10. Such areas could include places of attachment of various structures, including but not limited to a chair rail, handrail, crown moldings, fixtures, cabinets or other components. FIG. 1 depicts the horizontal blocking members 10 disposed horizontally between the vertical studs 4 located for attachment of a cabinet 12. Although metal is the preferred material, alternate materials are known to a person skilled in the art.

Figure 2:
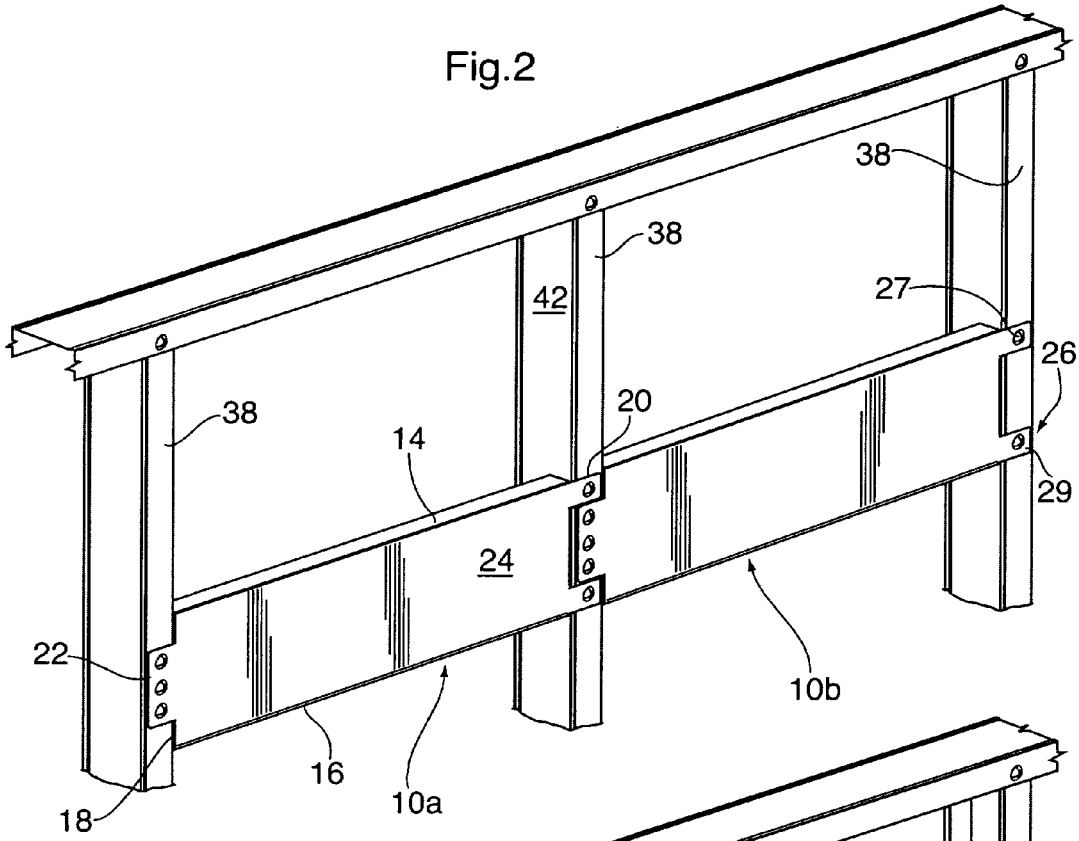
FIG. 2 illustrates a partial front view of the wall stud system where the horizontal blocking members are secured.
Figure 3:
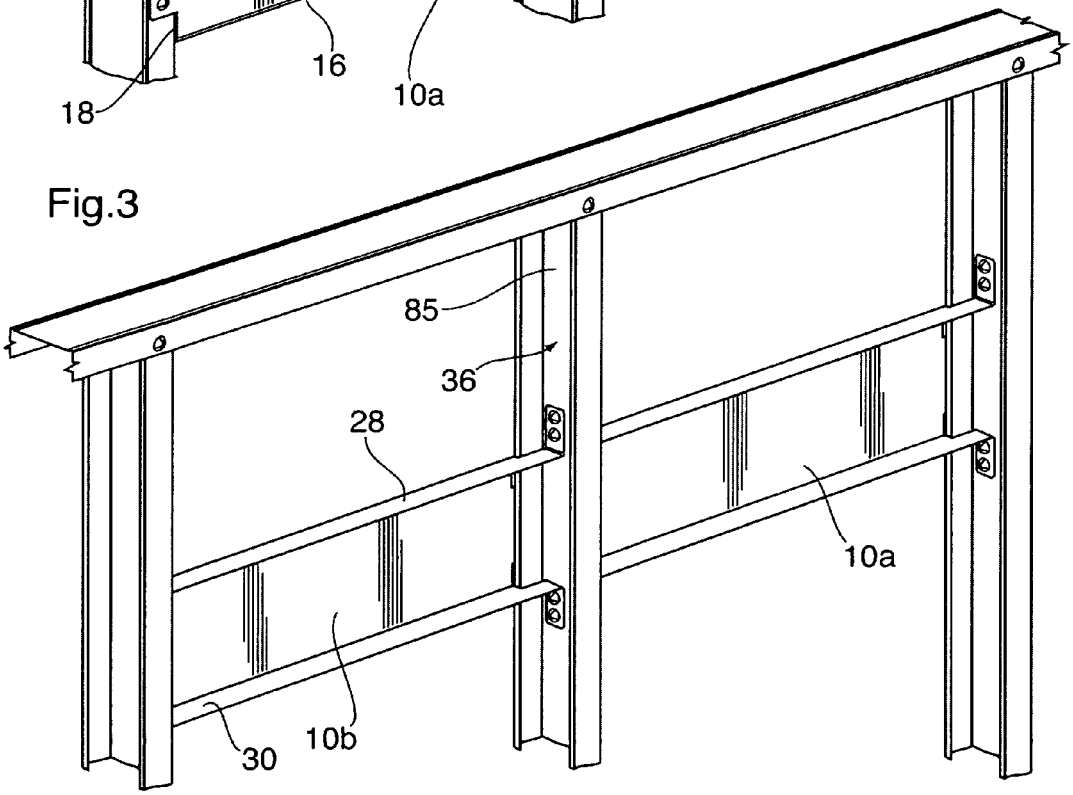
FIG. 3 illustrates a partial back view of the wall stud system where the horizontal blocking members are secured.

FIG. 2 illustrates a front view of a pair of horizontal blocking members 10, while FIG. 3 depicts a back view of the pair of horizontal blocking members. Each horizontal blocking member includes a top edge 14, a bottom edge 16, a first lateral edge 18 and a second lateral edge 20. The first lateral edge 18 includes a male flange 22 extending outwardly from the web 24 while the second lateral edge 20, includes a female attachment flange 26. The female flange 26 includes a first securement tab 27 and a second securement tab 29.

Figure 8:
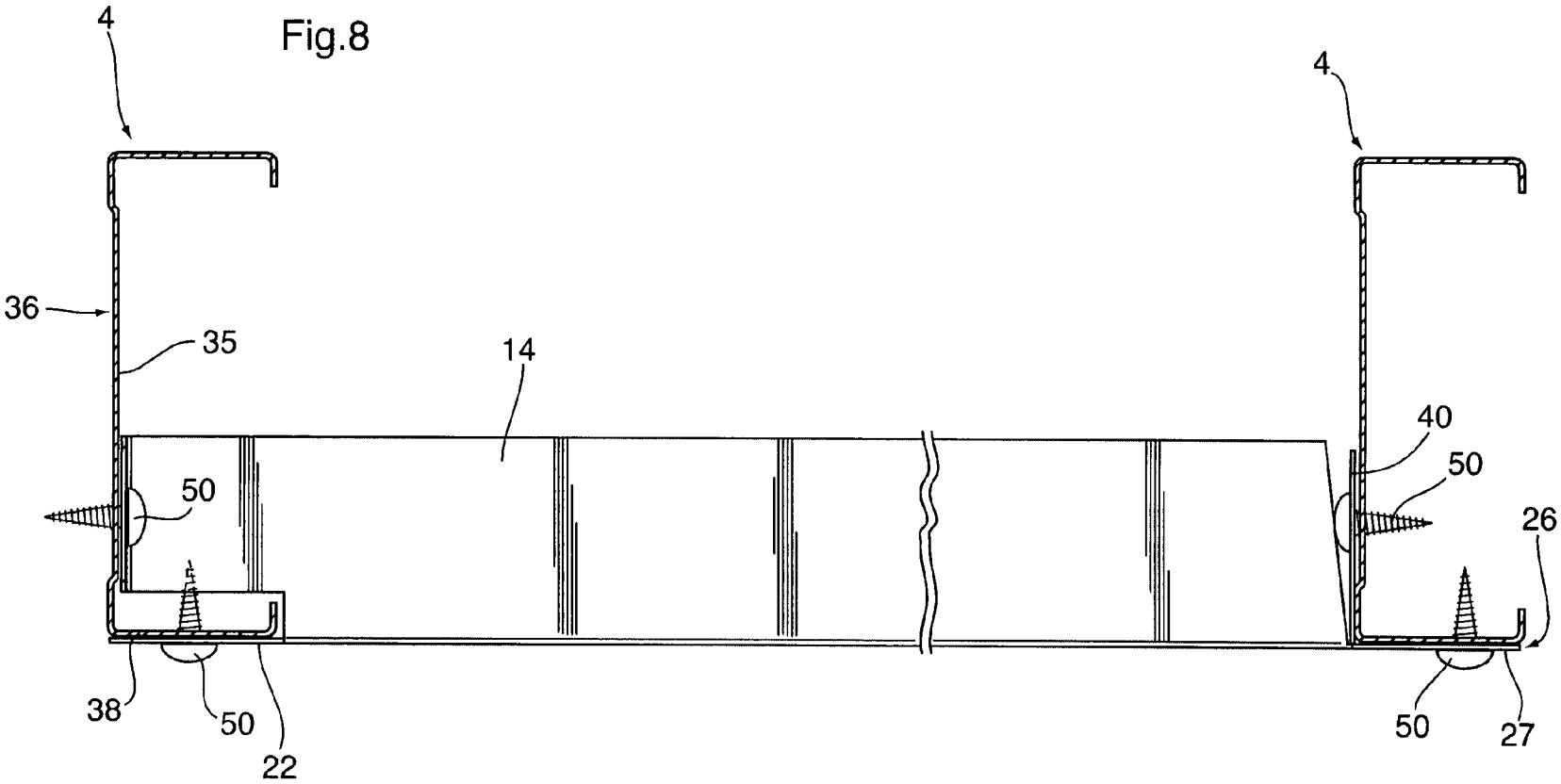
FIG. 8 illustrates a top view of the horizontal blocking member secured between two vertical support studs.

The male and female flanges are shaped such that when a first horizontal blocking member 10*a* is placed adjacent a second horizontal blocking member 10*b* the male flange 22 fits within the female flange 26 such that there is no large discontinuity in the width of the horizontal blocking members at the joint between a first horizontal blocking member 10*a* and a second horizontal blocking member 10*b*. It is preferable that the male flange 22 and the female flange 26 cooperate closely with each other, with the male flange 22 fitting closely within the female flange 26. Both the female flange 26 and male flange 22 provide points of securement to front flanges 38 of the vertical studs 4. This securement is shown in FIG. 8. The securement means shown are screws 50, however, securement can be accomplished by screws rivets or any other suitable securement means known to a person skilled in the art.

This male and female cooperation of the securement flanges allows for each of the male flange 22 and female flange 26 to be secured over the entire width of the front flange 38 of the vertical stud member 4.

Referring to FIG. 3, the horizontal blocking member preferably includes a top flange 28 extending rearwardly from the top edge 14 of the web 24 and a bottom flange 30 extending rearwardly from the bottom edge 16 of the web 24. Both the top flange 28 and bottom flange 30 are depicted as perpendicular to the web 24, however a variety of angles between the web and the top flange or bottom flange would be known to a person skilled in the art. The preferred angle between the flanges and the web is generally 90 degrees.

Figures 4, 5:
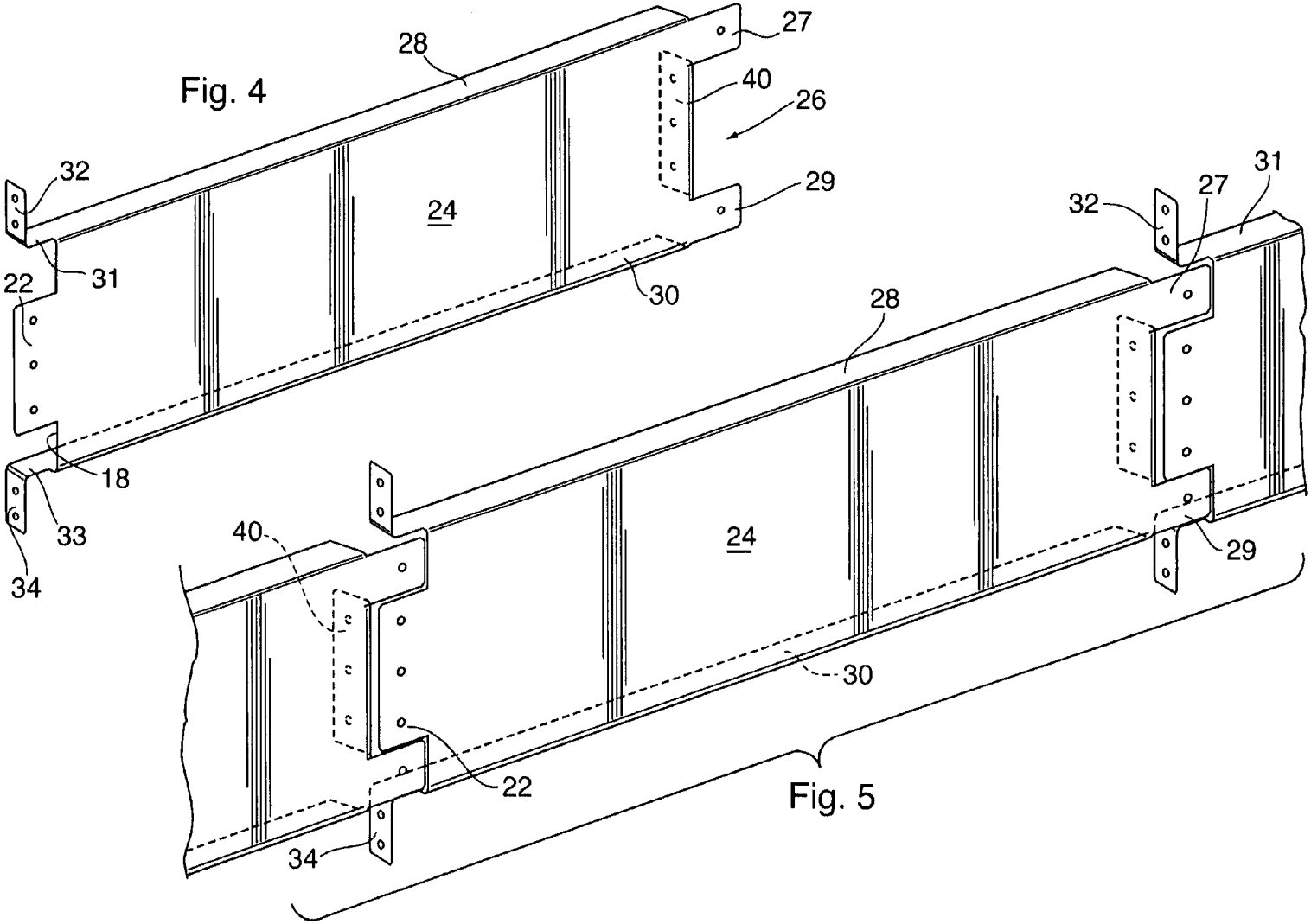
FIG. 4 illustrates a front view of the horizontal blocking member.
FIG. 5 illustrates a front view of a horizontal blocking member adjacent two other horizontal blocking members.

The top flange 28 and bottom flange 30 extend beyond the web 24 at the edge corresponding to the first lateral edge 18. These extensions 31 and 3, preferably terminate in a top upwardly extending foot 32 and a bottom downwardly extending foot 34, as seen in FIG. 4. The upwardly extending foot 32 and downwardly extending foot 34 are designed to contact the back side 35 web 36 of a vertical wall stud 4 and provide a point of securement. Securement can be accomplished by but not limited to screws, rivets or any other suitable securement means known to a person skilled in the art.

As can be seen in FIG. 4, preferably a rearwardly extending flap 40 is located between the top securement tab 27 and the bottom securement tab 29 of the female flange 26. This flap 40 allows for additional securement of the horizontal blocking member 10 to the vertical studs 4. The flap is situated adjacent the front surface 42 of the web 36 of the vertical studs 4. The rearwardly extending flap can be secured to the front surface of the web of the vertical stud 4 or left unsecured.

Figure 6:
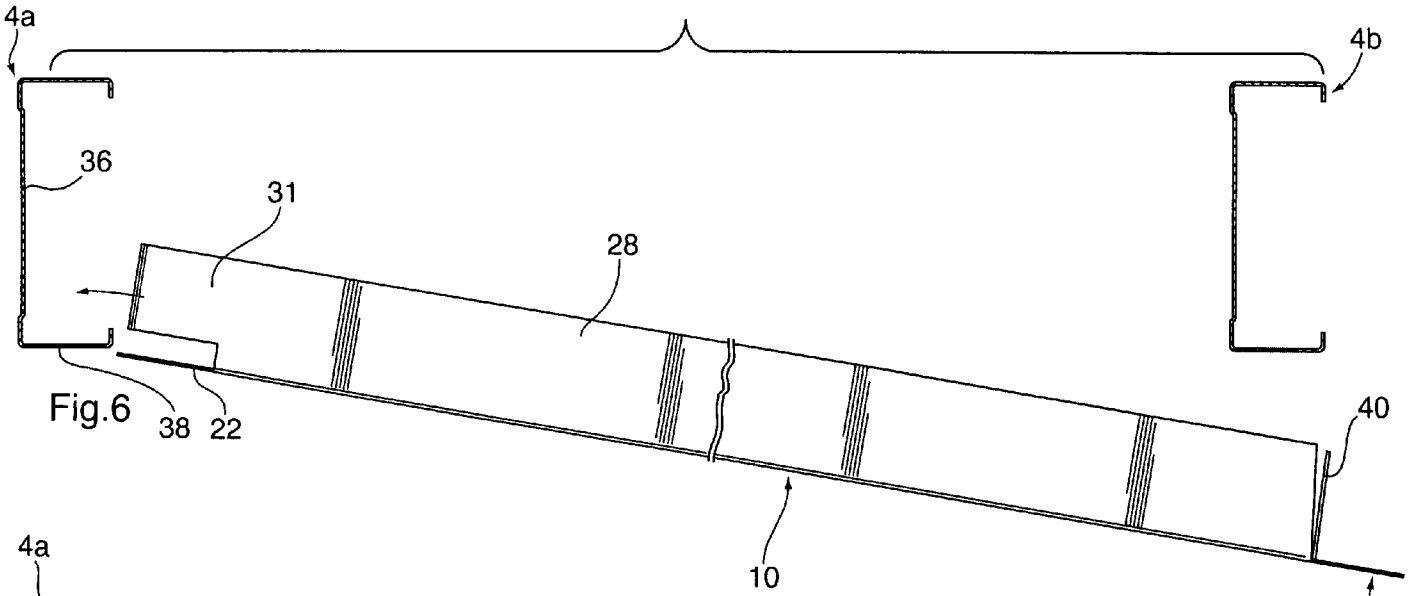
FIG. 6 illustrates a top view of the initiation of insertion of the horizontal blocking member between two vertical support studs.
Figure 7:
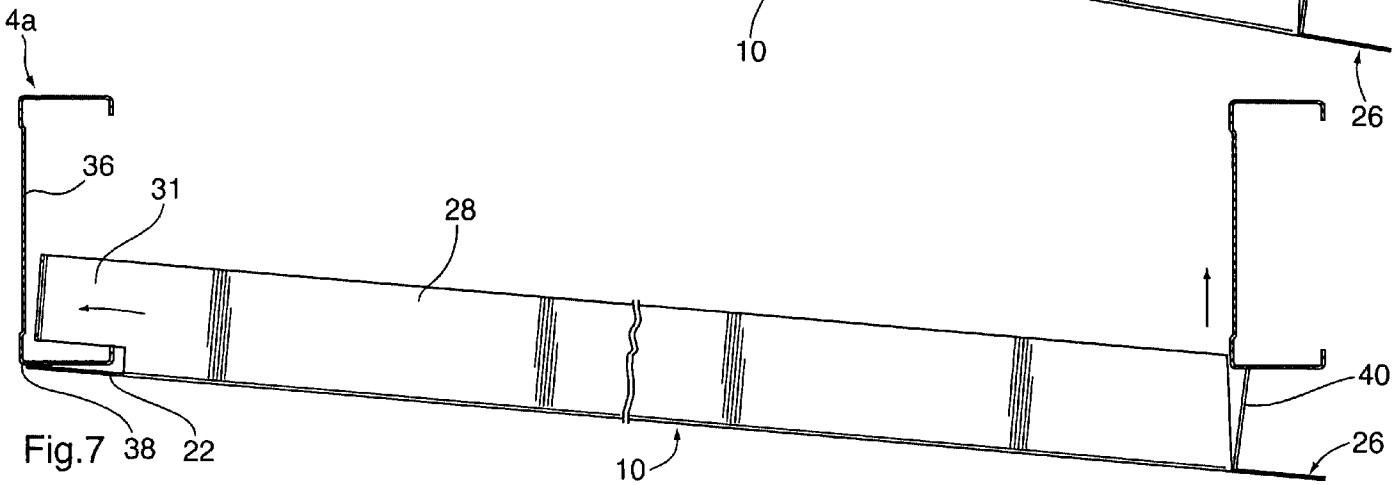
FIG. 7 illustrates the second step in the insertion of the horizontal blocking member between two vertical support studs.

The horizontal blocking member is simple to install and limited, if any, training would be necessary for workers in the construction field. FIGS. 5 and 6 depict a top view of the horizontal blocking member 10 being inserted between two vertical studs 4*a* and 4*b*. As shown in FIG. 6, the horizontal blocking member is angled such that male flange 22 remains forward of the front flange 38 of the vertical stud 4*a* while the top extension 31 and bottom extension 32 are located behind the front flange 38 of the vertical stud 4*a*. The horizontal blocking member 10 is then pushed toward the vertical stud 4*a* and backward until the female flange 26 is adjacent the front flange 38*b* of vertical stud 4*b*. The horizontal blocking member 10 is then in a position to be secured to the vertical studs 4*a* and 4*b*.

Although various preferred embodiments of the present invention have been described herein in detail, it would be appreciated by those skilled in the art that variations may be made thereto without departing from the spirit of the invention or the scope of the appended claims.

The embodiments of the invention in which an exclusive property or privilege is claimed are defined as follows:

1. A horizontal blocking member for use in a structural stud building system having a plurality of vertical parallel spaced apart support studs having a front flange and rear flange integrally connected to a web having a front and rear surface, the bridging member comprising a web having a top edge and a bottom edge, a first lateral edge extending between said top edge and said bottom edge, a second lateral edge opposite said first lateral edge extending between said top edge and said bottom edge wherein said first lateral edge includes a male portion and said second lateral edge includes a cooperating female portion such that when the first lateral edge of a first horizontal blocking member is placed adjacent the second lateral edge of a second horizontal blocking member the overall width and thickness of the blocking members is maintained at the joint between the first and second horizontal blocking members, a top flange integrally connected and extending from said top edge at an angle perpendicular to said web, a bottom flange integrally connected and extending from said bottom edge at an angle perpendicular to said web, a first securement structure to allow fasteners includes a first foot extending from said top flange and a second foot extending from said bottom flange adjacent said first lateral edge; wherein when positioned between said vertical studs, both said first foot and said second foot lie parallel and adjacent to said rear surface of said web of said vertical stud, a second securement structure to allow fasteners includes a securement flap located adjacent said second lateral edge; wherein said securement flap is attached to and directed perpendicular to said web and wherein when positioned between said vertical studs lies parallel and adjacent said front surface of said web of said vertical stud.

2. A horizontal blocking member as claimed in claim 1 wherein said male portion is in the form of a tab extending from said web of said horizontal blocking member.

3. A horizontal blocking member as claimed in claim 1 wherein said first foot, said second foot and said securement flap are adapted to be fastened to said web of said vertical stud.

4. A wall stud system comprising a first structural stud having a first flange and a second flange integrally connected to a web having a front and rear surface, a second structural stud having a first flange and a second flange integrally connected to a web having a front and rear surface; and being located parallel to and spaced from said first structural stud, at least one horizontal blocking member as claimed in claim 1 being located in the space between and mechanically fastened to said first structural stud and said second structural stud, said male portion of said horizontal blocking member being mechanically fastened to said first flange of said first structural stud and said female portion of said horizontal blocking member being mechanically fastened to said first flange of said second structural stud, said first foot and said second foot being mechanically fastened to the rear surface of the wall of said first structural stud and said securement flap being mechanically fastened to the rear surface of the web of said second structural stud.

* * * * *